US005097610A

United States Patent [19]

Bishop

[11] Patent Number: 5,097,610

[45] Date of Patent: Mar. 24, 1992

[54] COMPACT PADDING MACHINE

[75] Inventor: William B. Bishop, Albuquerque, N. Mex.

[73] Assignee: Bo-Ar Padding Co., Inc., Albuquerque, N. Mex.

[21] Appl. No.: 499,619

[22] Filed: Mar. 26, 1990

[51] Int. Cl.[5] ..... E02F 1/00

[52] U.S. Cl. ..... 37/142.5; 37/117.5; 405/179; 209/307; 209/420; 209/257

[58] Field of Search ..... 37/104, 107, 142.5; 171/123, 127, 130; 209/235, 241, 257, 420, 421, 307; 405/179, 174

[56] References Cited

U.S. PATENT DOCUMENTS

| | | | |
|---|---|---|---|
| 750,005 | 1/1904 | Quertier | 171/16 |
| 1,681,457 | 8/1928 | Asplund | 171/63 |
| 1,876,137 | 9/1932 | Engelen | 171/13 |
| 2,296,851 | 9/1942 | Henry | 171/9 |
| 2,453,714 | 11/1948 | Lapointe | 171/130 |
| 2,598,223 | 5/1952 | Chase | 171/130 |
| 2,653,701 | 9/1953 | Heth | 37/252 X |
| 2,725,700 | 12/1955 | Fahrenholz | 171/12 |
| 2,814,387 | 11/1957 | McWilliams | 209/247 |
| 2,857,691 | 10/1958 | Curran | 37/142.5 X |
| 2,918,980 | 12/1959 | Suko et al. | 172/29 |
| 3,003,265 | 10/1961 | Lutjens | 37/118 R |
| 3,072,257 | 1/1963 | Hockenberry | 209/421 X |
| 3,280,977 | 10/1966 | Looker | 209/307 |
| 3,340,935 | 9/1967 | Csimma | 171/130 |
| 3,395,798 | 8/1068 | Erickson | 209/260 |
| 3,645,019 | 2/1972 | Mengis et al. | 37/82 |
| 3,701,422 | 10/1972 | Downey | 209/241 |
| 3,732,980 | 5/1973 | Evers et al. | 209/421 |
| 3,900,392 | 8/1975 | Speno et al. | 209/241 |
| 3,903,624 | 9/1975 | Holl | 37/142.5 X |
| 3,908,292 | 9/1975 | Harris | 37/142.5 |
| 3,981,089 | 9/1976 | Burrows | 37/142.5 |
| 3,998,396 | 12/1976 | Umphrey et al. | 209/257 X |
| 4,157,956 | 6/1979 | Robinson | 209/260 |
| 4,262,477 | 4/1981 | Turold et al. | 171/127 X |
| 4,363,725 | 12/1982 | Morita et al. | 209/257 |
| 4,633,602 | 1/1987 | Layh et al. | 37/195 |
| 4,664,791 | 5/1987 | McClain et al. | 209/421 |
| 4,861,461 | 8/1989 | Utterback | 209/241 X |
| 4,912,862 | 4/1990 | Bishop et al. | 37/142.5 |
| 4,948,299 | 8/1990 | Cronk, Jr. et al. | 405/179 |

FOREIGN PATENT DOCUMENTS

| | | | |
|---|---|---|---|
| 2219330 | 12/1989 | United Kingdom | 37/142.5 |

*Primary Examiner*—Randolph A. Reese
*Assistant Examiner*—Arlen L. Olsen
*Attorney, Agent, or Firm*—Deborah A. Peacock; Donovan F. Duggan

[57] ABSTRACT

A compact padding machine for screening and conveying soil into a trench. The machine is usable as an attachment to a conventional bucket loader, bulldozer or other base machine. The padding machine includes a screening belt, an underlying inclined conveyor belt, and a transverse, extendible discharge conveyor belt. Soil is collected and conveyed upwardly on the screening belt. Fine grained soil passes through the screening belt, is deposited onto the inclined conveyor belt, and is discharged therefrom onto the transverse conveyor belt, from where it may be conveyed into an adjacent trench. A hydraulic vibrator is coupled to the screening belt to disaggregate clods of fine-grained soil and cause the soil to pass through the screening belt. Rocks and other large objects are conveyed to the rear of the machine and discharged. An auxiliary attachment may be used to collect discharged rocks and convey them away from the path of the following base machine, either by conveying them into the trench, on top of the screened soil, or by conveying them to the opposite side of the padding machine, away from the trench. A pivotable auxiliary conveyor belt is also available to enable screened soil to be discharged at variable distances from the machine.

26 Claims, 6 Drawing Sheets

COMPACT PADDING MACHINE

BACKGROUND OF THE INVENTION

1. Field of the Invention (Technical Field)

The invention described and claimed herein is generally related to earth moving machines and apparatus. More particularly, the present invention is related to padding machines.

2. Description of the Related Art Including Information Disclosed under 37 C.F.R. §§1.97-1.99 (Background Art)

Underground cables and pipelines are typically emplaced by laying the cable or pipeline in a prepared trench and subsequently backfilling the trench.

Some cables and pipelines are susceptible to damage from stones or other hard objects in the backfill material. For example, optical fiber communications cables are considered particularly susceptible to damage in this manner, as are polymeric or plastic pipelines. Also, steel pipes are increasingly provided with protective polymeric coatings, which must be protected from penetration or damage by hard objects.

Consequently, in the laying of cables and pipelines it is increasingly sought to backfill the trench with fill material that is relatively free of stones or other hard objects. One way to achieve this is to backfill the trench with sand or other suitable fill material brought from a remote source of sand or rock-free soil. This approach is however relatively expensive and time-consuming. Further, where steel pipe is covered with a layer of sand, the filled trench tends to collect standing water in the porous sand fill, leading to premature corrosion of the pipe. Also, the use of a fill material that is different from the surrounding soil results in a loss of cathodic protection, which also leads to premature corrosion of steel pipe.

The alternative is to screen the soil dug from the trench, to remove stones and other foreign objects, and return the screened soil to the trench. Several machines, known as padding machines, have been disclosed in the prior art for this purpose. For example, U.S. Pat. No. 2,857,691 to Curran discloses a tracked vehicle having a vertically swingable boom that extends laterally over a trench. The boom includes a tube having an enclosed auger. At the far end of the boom from the vehicle is a rotating head which scoops up soil from alongside the trench, screens the soil, and transmits it to the auger, which conveys the screened soil along the tube and into the trench through openings in the tube. The Curran apparatus is particularly designed for use with a vehicle that is driven along the opposite side of a trench from the pile of soil that was removed from the trench and which extends alongside the trench.

U.S. Pat. No. 4,633,602, to Layh, et al., teaches the use of a gathering belt which dumps material onto a separator screen, allowing fines to fall onto a lateral belt. This device does not provide for screening during the initial conveying nor for attachment to vehicles, such as loaders and bulldozers.

U.S. Pat. No. 3,596,384 to Neujahr employs an auger to remove soil from the piled ridge of soil removed from a trench to a second auger, which conveys the soil to a screen and to a set of impellers which throw the screened soil into the trench.

U.S. Pat. No. 4,301,910 to Price also discloses a self-propelled backfilling machine which utilizes a conveyor belt to transport soil from a hopper into a trench.

U.S. Pat. No. 4,664,791, issued May 12, 1987 to McClain et al., also discloses a padding machine particularly designed to receive backfill material in a hopper and to sieve the material and dispense it into a trench.

The padding machines presently available are generally large machines, which are intended and useful primarily for long-distance pipe laying operations in open country, where rights of way are wide and where there is little or no rugged terrain. Such machines have limited usefulness where rights of way are narrow, where trenches do not follow a straight path, or where the terrain is relatively rugged.

SUMMARY OF THE INVENTION (DISCLOSURE OF THE INVENTION)

Accordingly, it is an object and purpose of the present invention to provide an improved padding machine which operates to continuously screen soil alongside a trench and at least partially backfill the trench with the screened soil.

It is another object of the present invention to provide a padding machine which attains the foregoing objective and which also is selectively operable to either collect stones and other hard objects encountered in the soil, or to dispose of such objects alongside the trench, or in the trench on top of the screened soil.

It is also an object of the present invention to provide a padding machine which is operable in confined areas and in rugged terrain.

It is yet another object of the present invention to provide a padding machine which is compact, portable, and which may be operated as an attachment to a base machine, such as a conventional loader, backhoe, or other vehicle.

It is another object of the present invention to provide a padding machine which is self-loading.

The present invention generally provides a padding machine which is adapted to be attached to a prime mover such as a loader, tractor, backhoe or other vehicle. The padding machine is operable to continuously lift and screen soil from a piled ridge extending alongside a trench, and to convey the screened soil into the trench, while collecting or discarding stones and other large objects in soil.

The preferred padding machine of the invention includes a frame which supports an inclined screening belt. The screening belt is driven continuously so as to carry soil upwardly as the machine is driven along a ridge of loose soil. Beneath the screening belt is an inclined conveyor belt, which is also driven continuously in an upward direction. Both the screening belt and the inclined conveyor belt extend in a direction parallel to the direction of travel of the machine, as well as the direction of the trench and direction of the adjacent pile of soil. The screening belt is made of coarse chain mail or other material suitable to selectively pass through it soil that is sufficiently fine-grained and free of stones that it may be used as the first stage of padding backfill to be deposited into a trench containing a pipeline or cable. The screened soil that is passed through the screening belt falls onto the inclined conveyor belt, which is imperforate to such screened soil, where it is carried upwardly and dropped onto a transverse conveyor belt, which extends outwardly over the adjacent open trench. The screened soil is carried along the transverse conveyor belt and dumped into the trench. The transverse conveyor belt is preferably powered by a reversible hydraulic motor and is slidably mounted on support rails, such that it can be extended transversely in either direction from the padding machine, so as to allow padding of a trench on either side of the padding machine.

Rocks and other debris too large to pass through the screening belt are carried upwardly and over the rear end of the screening belt. They may be simply left alongside the trench if appropriate, or they may be collected in a suitable container for later disposal elsewhere. In a preferred embodiment the padding machine is particularly adapted for attachment to a loader, in which case the rocks and debris may be collected in the front scoop of the loader.

The invention further provides an auxiliary attachment which may be interposed between the rear of the padding machine and the loader or other base machine to which the padding machine is attached. The auxiliary attachment includes a rock conveyor belt which is extendible in either direction from the padding machine, so as to convey discarded rocks either into the trench, on top of the padding fill previously deposited by the padding machine, or to the opposite side of the drive vehicle from the trench.

Another auxiliary attachment is a pivotable conveyor belt, which is pivotably attached to the rear of the padding machine and which is operable to receive the screened soil from the transverse conveyor belt. The auxiliary conveyor belt can be selectively positioned and extended to convey the screened soil to a discharge point at a greater distance from the padding machine, thus enabling the padding machine to process soil which may be at varying distances from the adjacent trench.

The machine preferably includes a mechanical vibrator coupled to the screening belt to assist in breaking up clods of soil on the screening belt and thereby facilitate passage of the soil through the screening belt.

The padding machine may draw upon hydraulic power from the auxiliary power output typically found on conventional loaders or other vehicles, such as backhoes, bulldozers, trucks, and the like. Alternatively, the padding machine may have a self-contained engine and hydraulic power source. The padding machine may itself be self-propelled, preferably by means of tracks.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

Figure 1:
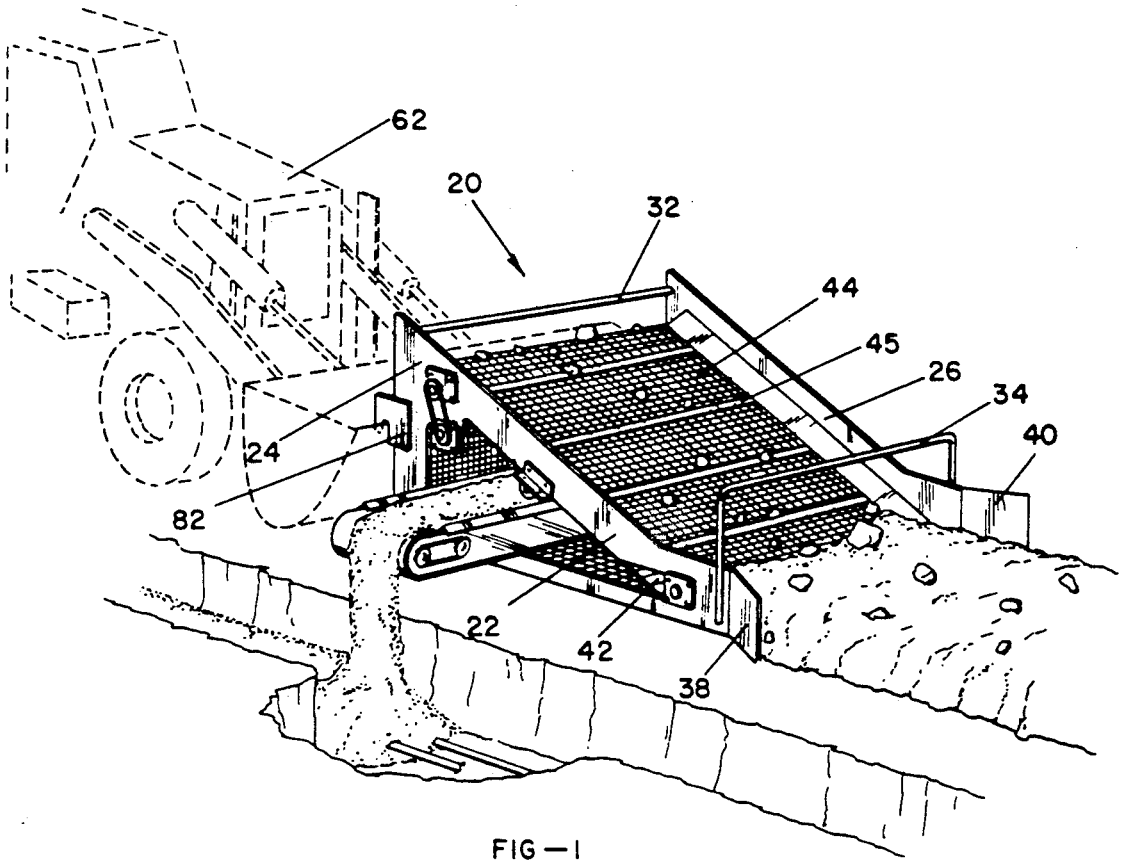
FIG. 1 is an isometric view of a preferred embodiment of the padding machine of the present invention, shown attached to a conventional loader and being used to partially backfill a trench containing a pipeline or cable.
Figure 2:
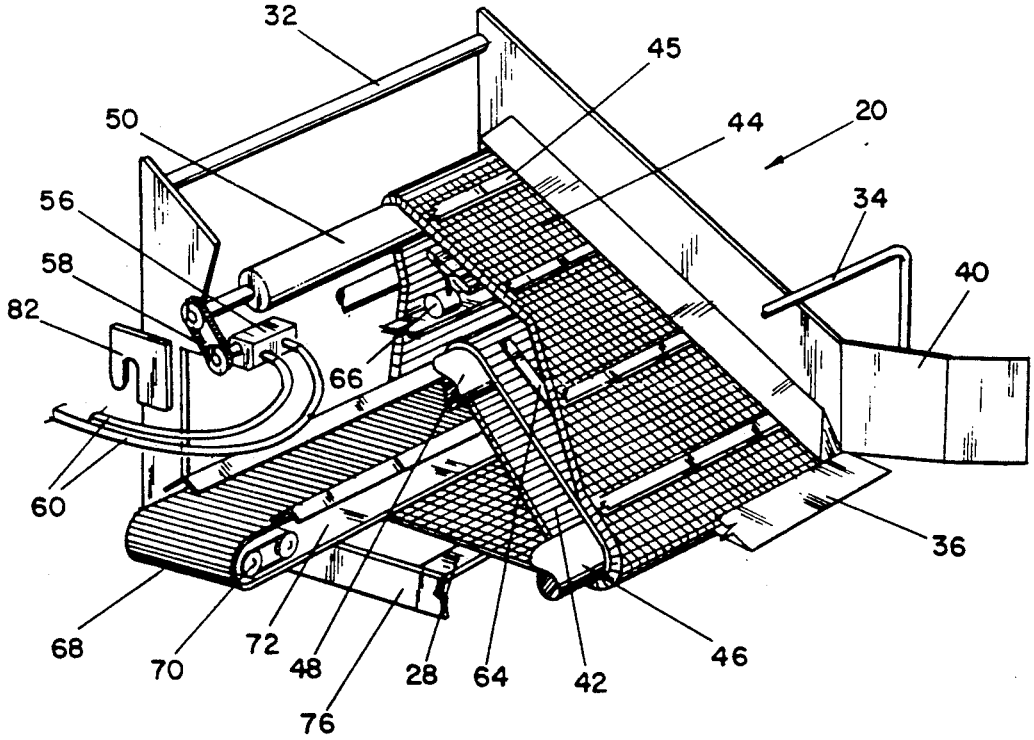
FIG. 2 is a cut away isometric view of the padding machine shown in FIG. 1.

DETAILED DESCRIPTION OF THE PREFERRED EMBODIMENTS OF THE INVENTION (BEST MODES FOR CARRYING OUT THE INVENTION)

Referring to FIGS. 1 through 6, there is illustrated a padding machine 20 which constitutes a preferred embodiment of the present invention. The padding machine 20 includes an angular frame 22 which includes a pair of triangular side frame members 24 and 26. The side frame members 24 and 26 are connected by several cross members, including several bottom frame members 28 or a solid plate, or a rear cross plate, and can include optional reinforcing members, cross bars, or safety bars (e.g., 32 and 34). Additionally, the padding machine 20 includes a lip 36 which spans and connects the side frame members 24 and 26 at the forward end of the machine 20, and which is positioned to be located at ground level and to function as a cutting blade when the machine 20 is in operation. The side frame members 24 and 26 further include outwardly disposed wings 38 and 40 at their lower front ends, which function to collect and guide soil toward the center of the machine 20.

The padding machine 20 further includes an inclined conveyor belt 42 and an inclined screening belt 44. The conveyor belt 42 is a reinforced elastomeric belt, of the type customarily used in conveyor applications. The screening belt 44 is a chain link belt, preferably having a chain link spacing size on the order of approximately one-half to one inch. The screening belt 44 may preferably have a number of raised cross bars 45 on its outer surface, which function to assist in scooping earth onto end of the screening belt 44.

Figure 3:
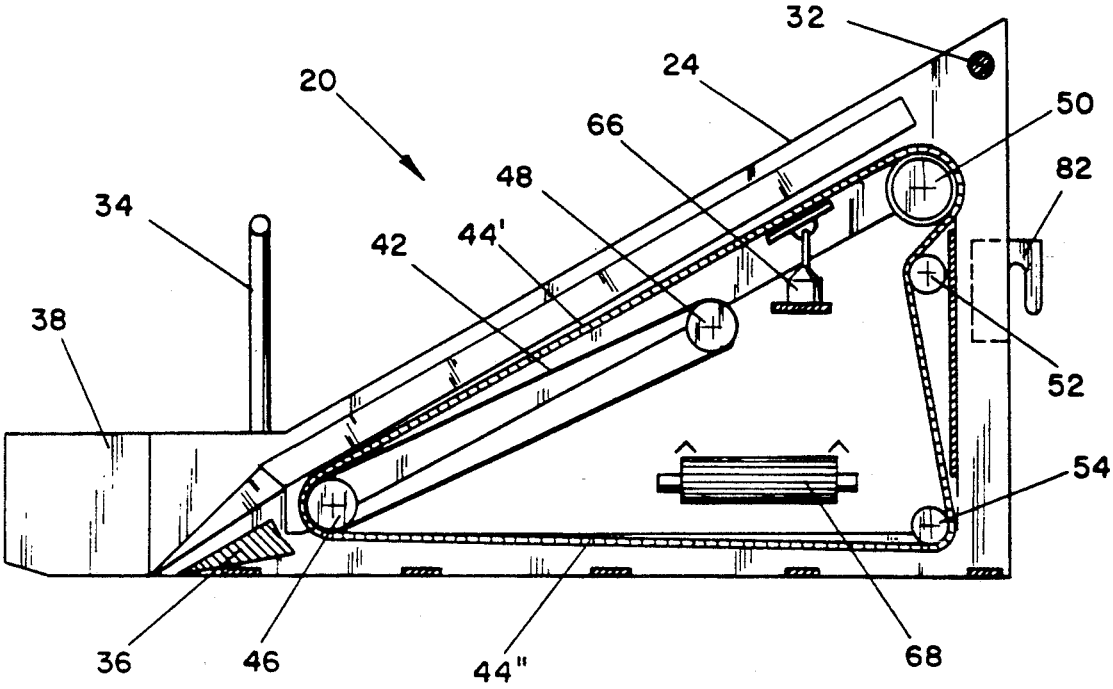
FIG. 3 is a side view in cross section of the padding machine of FIG. 1.
Figure 4:
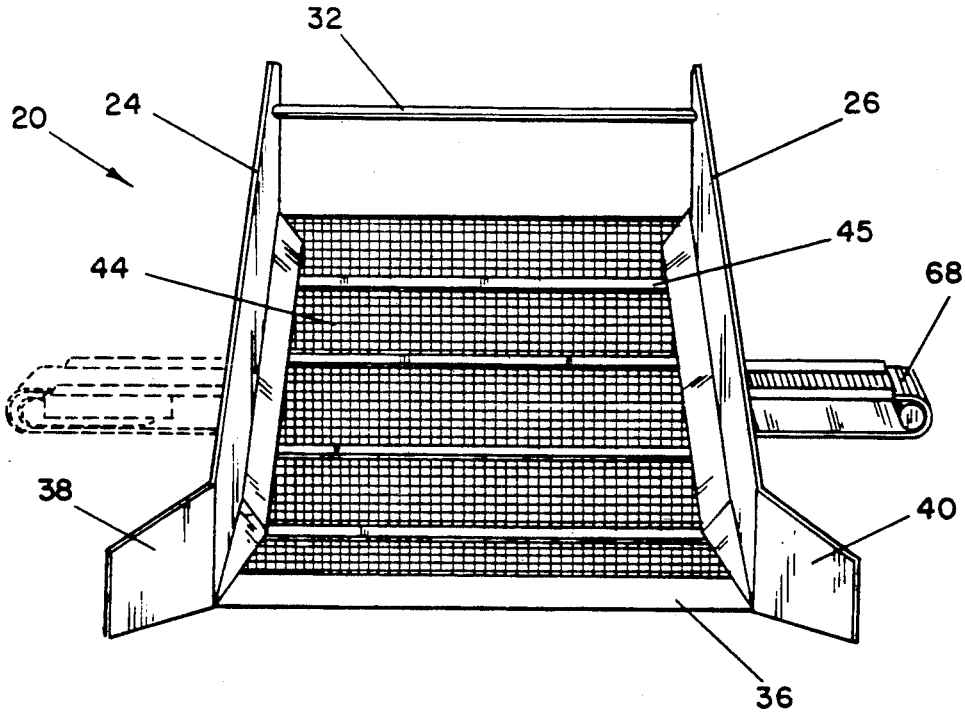
FIG. 4 is a front view of the padding machine of FIG. 1, with the conveyor belt shifted to the opposite side.
Figure 5:
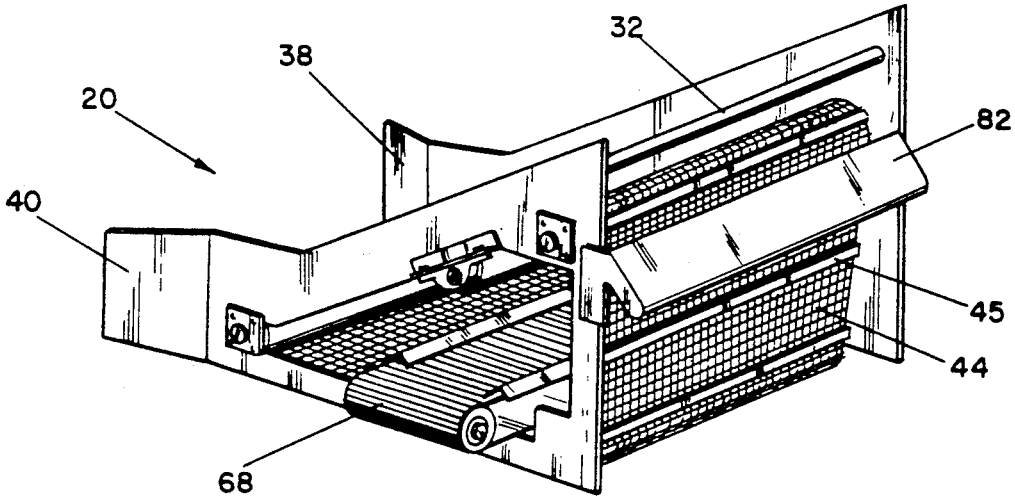
FIG. 5 is an isometric view of the padding machine of FIG. 1.

The conveyor belt 42 travels on a lower roller 46 and an upper roller 48, which are journalled in associated bearings mounted in the side frame members 24 and 26. The screening belt 44 also travels on the lower roller 46, and rides on top of the conveyor belt 42. Additionally, the screening belt travels over an upper drive roller 50 which is located at the top and rear of the frame 22, an idler roller 52 located beneath and slightly forward of the drive roller 50, and a lower roller 54 located at the rear lower corner of the frame 22. The rollers 50, 52 and 54 are all journalled in associated bearings which are mounted on the side frame members 24 and 26. As best depicted in FIG. 3, screening conveyor belt 44 further comprises an upper run 44' between drive roller 50 and lower roller 46, and a lower run 44" between lower roller 54 and lower roller 46. Imperforate conveyor belt 42 is positioned between and bounded by upper run 44' and lower run 44".

The drive roller 50 is driven by a hydraulic motor 56 which is mounted on the side frame member 24. The hydraulic motor 56 is connected to the drive roller 50 by a drive chain 58 and associated sprockets. The hydraulic motor 56 may be connected by means of hydraulic hoses 60 to a conventional auxiliary hydraulic power output, for example an hydraulic power output of a loader 62 as shown in FIG. 1.

The motor 56 drives the screening belt 44 by means of the drive roller 50. The screening belt 44 in turn drives the conveyor belt 42 as a consequence of traveling over the conveyor belt on roller 46. As a result the conveyor belt 42 and the screening belt 44 travel at the same speed.

Several tapered polymeric spacers 64 are positioned between the screening belt 44 and the conveyor belt 42, near the upper end of the conveyor belt 42. The spacers 64 operate to cause the screening belt 44 to separate from the conveyor belt 42 as the screening belt 44 and conveyor belt 42 travel upwardly from the lower roller.

A hydraulically driven vibrator 66 is mounted beneath the screening belt 44 at a position just beyond the roller 48. The vibrator 48 positioned to shake the screening belt 44 as it passes beyond the end of the conveyor belt 42.

The padding machine 20 further includes a transverse discharge conveyor belt 68, which extends transversely with respect to the longitudinal axis and the direction of travel of the padding machine 20. The discharge conveyor belt 68 is positioned directly beneath the upper end of the inclined conveyor belt 42, so as to receive soil carried upwardly on the conveyor belt 42 and discharged over roller 48. The discharge conveyor belt 68 extends outwardly through an opening in the side frame member 24, and extends up to several feet from the frame 22 to as to enable fine-grained soil to be conveyed into a nearby trench.

The discharge conveyor belt 68 travels on rollers 70 which are journalled to an elongate conveyor frame 72. A reversible hydraulic motor, mounted within the elongate conveyor frame 72, drives the discharge belt 68. The conveyor frame 72 rests on transverse support rails 76. The conveyor frame 72 and the discharge belt 68 may be slid in either direction on the support rails 76, so as to be extendible from either side of the padding machine 20. This arrangement enables screened soil to be discharged into a trench on either side of the padding machine 20.

The rear ends of the padding machine side frame members 24 and 26 each include an upper ear 78 and a lower ear 80 (e.g., see FIG. 8), by which the padding machine can be attached to the arms of a conventional loader 62, as shown for example in FIG. 1. The side frame members 24 and 26 also include hooks 82, by which the padding machine can be engaged and supported by a bucket of a loader or bulldozer, as shown for example in FIG. 6. The hooks 82 and 84 are adapted to receive a conventional bucket.

Figure 6:
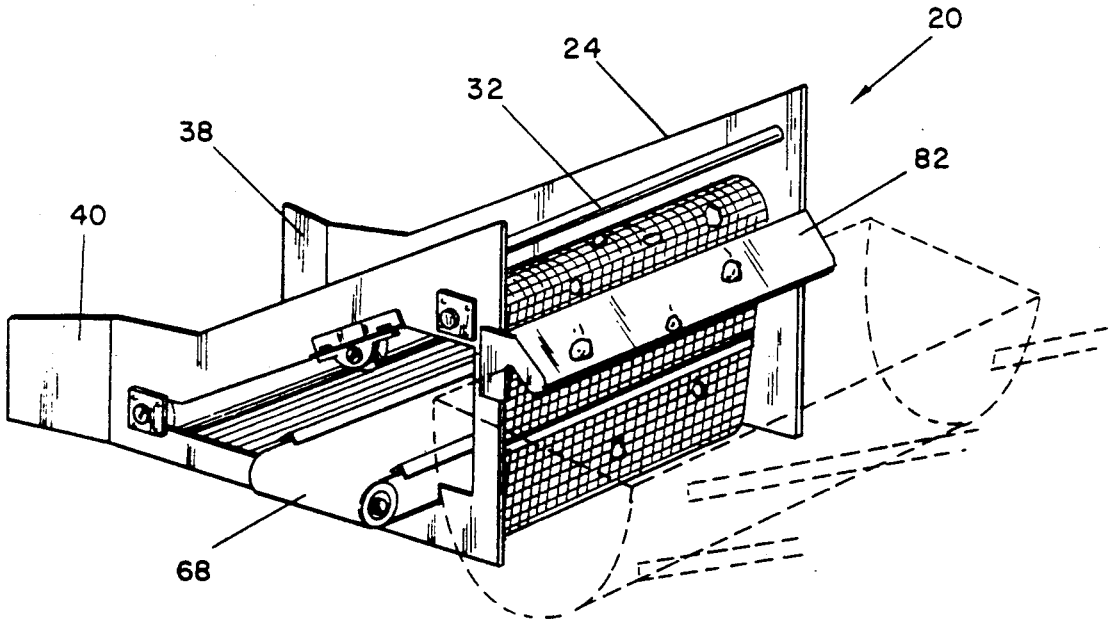
FIG. 6 is an isometric rear view of the padding machine of FIG. 1, shown attachable to a bucket of a loader or bulldozer.

In operation, the padding machine is attached to the front end of a loader, such as the loader 62 shown in FIG. 1, or the bucket of a bulldozer or loader as shown in FIG. 6. The padding machine is powered by the auxiliary hydraulic output of the loader 62. The padding machine 20 is positioned with the lip 36 at ground level, and is normally driven along the ridge of earth, or berm, that is formed adjacent a trench by conventional trench digging equipment. The lip 36 and the wings 38 and 40 collect the earth and guide it onto the screening belt 44.

As the earth is carried up the screening belt 44, fine grained soil passes through the screening belt 44 and onto the inclined conveyor belt 42, from where it is discharged onto the transverse discharge belt 68 and conveyed into the nearby trench. Rocks are carried to the top of the screening belt 44 and are discharged onto the ground behind the padding machine. Screening belt 44 thus performs the functions of screen and conveyor. Alternatively, rocks may be collected in a bucket behind the padding machine, or they may be conveyed to one side or the other by the auxiliary device described below, or they may be carried towards a bar to force rock to either side and down a chute (not shown).

The vibrator 66 serves to break up clods of fine grained soil and thereby facilitate its passage through the screening belt 44. The vibrator 66 is particularly useful where soil is damp or wet.

Figure 7:
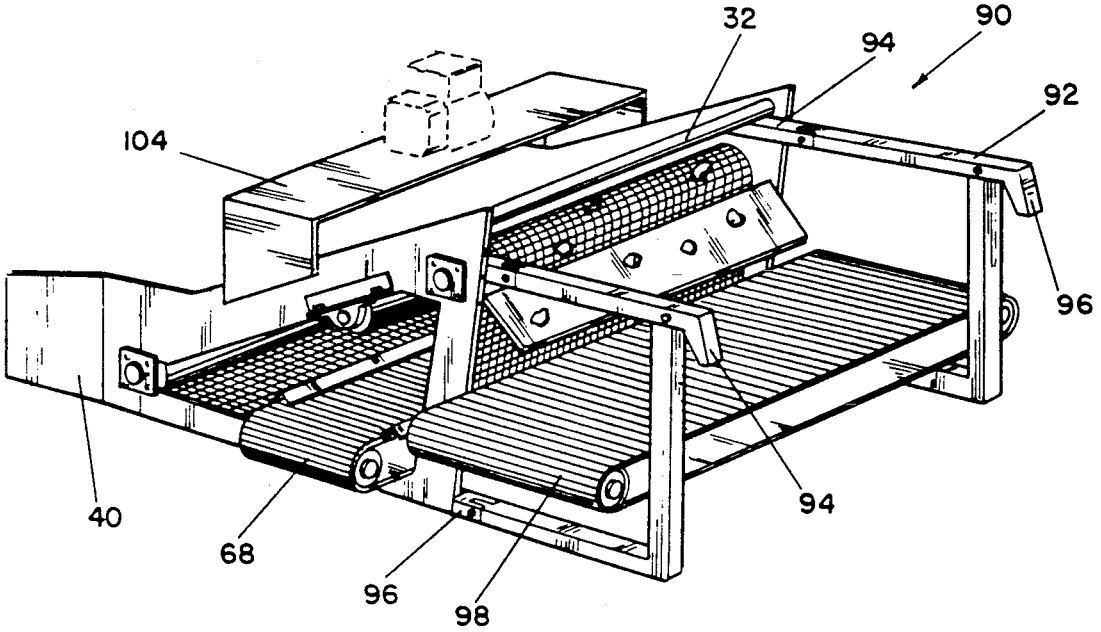
FIG. 7 is an isometric view of the machine of FIG. 1, together with an auxiliary rock conveyor, both attachable to a loader.
Figure 8:
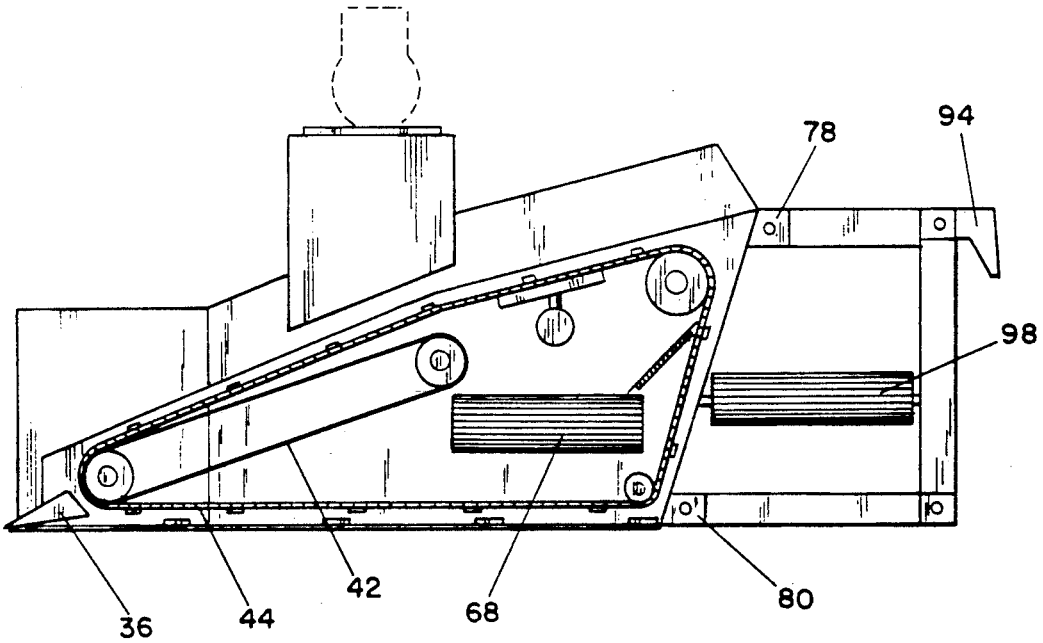
FIG. 8 is a side view of the padding machine and attached rock conveyor of FIG. 6.

FIGS. 7 and 8 illustrate the padding machine of FIG. 1, together with an auxiliary attachment 90 which conveys rocks and coarse clods of soil away from the path of the loader. The auxiliary attachment consists of a frame 92 which is adapted to be attached to the padding machine 20 at the attachment ears 78 and 80. The auxiliary attachment 90 also includes upper and lower pairs of ears 94 and 96, respectively, which are sized and positioned in the same manner as the padding machine ears 78 and 80, so that the padding machine and attached auxiliary attachment can be attached to a loader in the same manner as the padding machine 20 alone.

The auxiliary attachment 90 includes a transverse conveyor belt 98, which rests on rail supports in the same manner as the conveyor belt 68. The conveyor belt 98 is thus extendible in either direction. When extended away from the trench it will convey rocks away from the trench and away from the path of the loader. Alternatively, the conveyor belt 98 may be extended over the trench, so as to convey rocks back into the trench, on top of the immediately preceding layer of fine grained soil deposited by the padding machine 20.

The use of the auxiliary attachment 90 is optional. Its utility in particular situations is determined by the amount of coarse rock in the soil; the desirability of leaving rock alongside the filled trench; and other factors.

Figure 9:
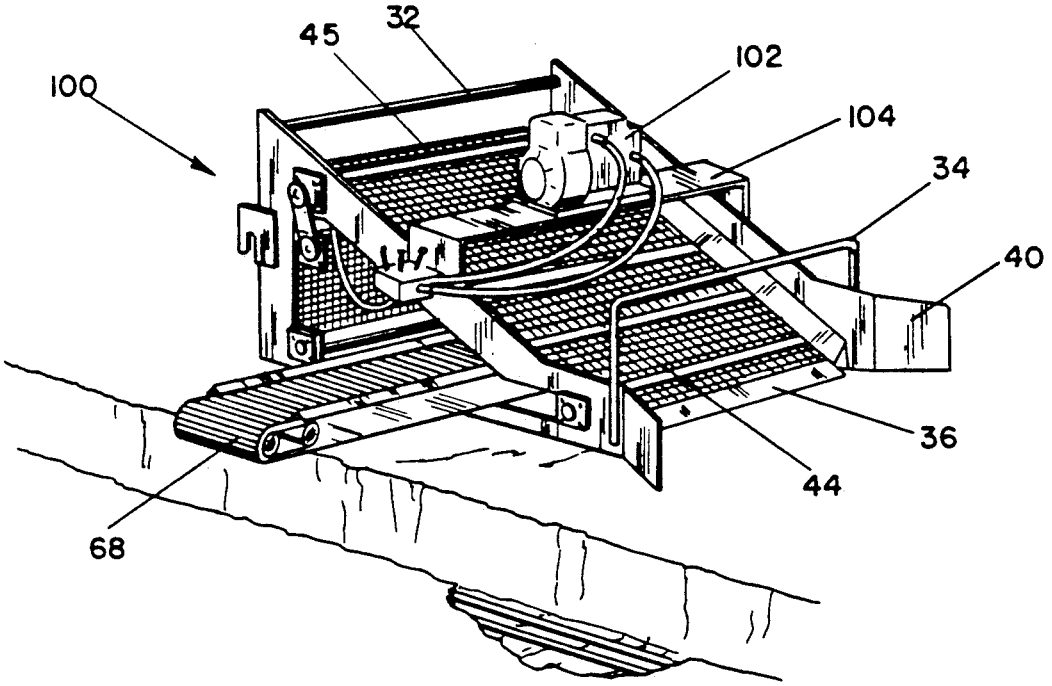
FIG. 9 is an isometric view of an alternative preferred embodiment of the padding machine of the present invention, which includes a motor.

FIG. 9 illustrates a padding machine 100 which is an alternative preferred embodiment of the present invention. In FIG. 9, elements of the padding machine 100 that are substantially identical to corresponding elements in the embodiment of FIGS. 1 through 6 are numbered in the same manner as the earlier embodiment, and will not be described again here.

The padding machine 100 of FIG. 9 is notable in that it includes a self-contained hydraulic power unit 102, which is mounted on a cross bar 104 above the screening belt 44. The self-contained hydraulic power unit 102 enables the padding machine 100 to be quickly and easily attached or detached from a bucket loader, bulldozer or other vehicle. This enables the bucket loader, bulldozer or other vehicle to be quickly made available for performing other necessary work, for example in the preparation of the mound of soil for processing with the padding machine 100.

Figure 10:
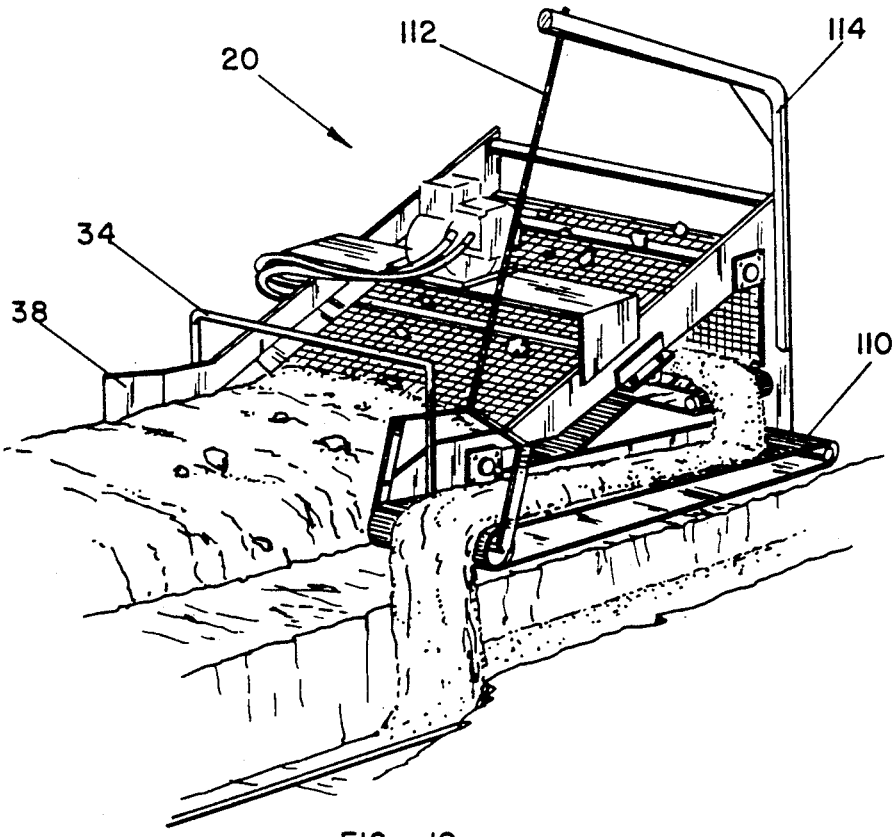
FIG. 10 is an isometric illustration of the preferred embodiment of FIG. 1, provided with an auxiliary conveyor belt for depositing fines at a point forward of the padding machine.

FIG. 10 illustrates the padding machine 20 of FIGS. 1 through 6, provided with an auxiliary conveyor belt 110. The auxiliary conveyor belt 110 includes a self-contained hydraulic motor, in the same manner as the conveyor belt 68. The auxiliary conveyor belt 110 is pivotably connected to the rear of the padding machine 20, and is suspended by a cable 112 from a pivotable swing arm 114. The conveyor belt 110 is positioned to receive screened soil discharged from the primary conveyor belt 68. The pivotable swing arm 114 enables the conveyor belt 110 to be swung into various positions, so as to enable the screened soil to be conveyed and discharged at variable distances from the padding machine 20. This enables the padding machine 20 to continuously process a ridge of soil that may be at varying distances from the trench.

Figure 11:
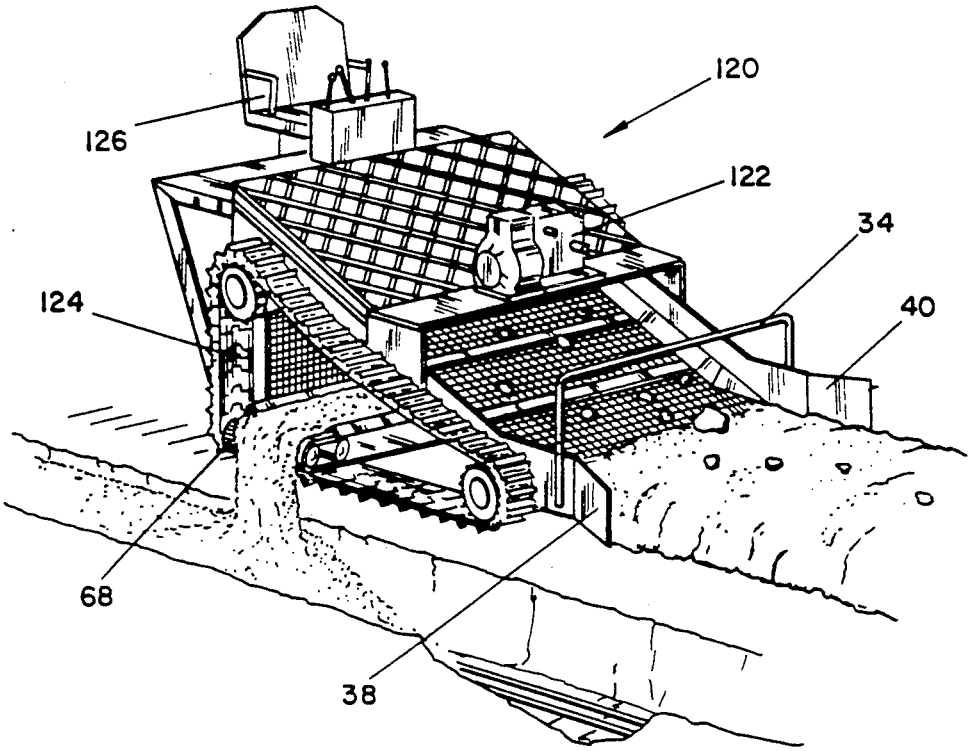
FIG. 11 is an isometric view of an alternative preferred embodiment of the invention, wherein the padding machine is self propelled by means of tracks and an integral power supply.

FIG. 11 illustrates a padding machine 120 which is another alternative preferred embodiment of the present invention. The machine 120 is self-propelled and has a self-contained motor 122. The padding machine 120 is propelled by tracks 124. An operator's seat 126 is provided at the rear of the padding machine 120.

Figure 12:
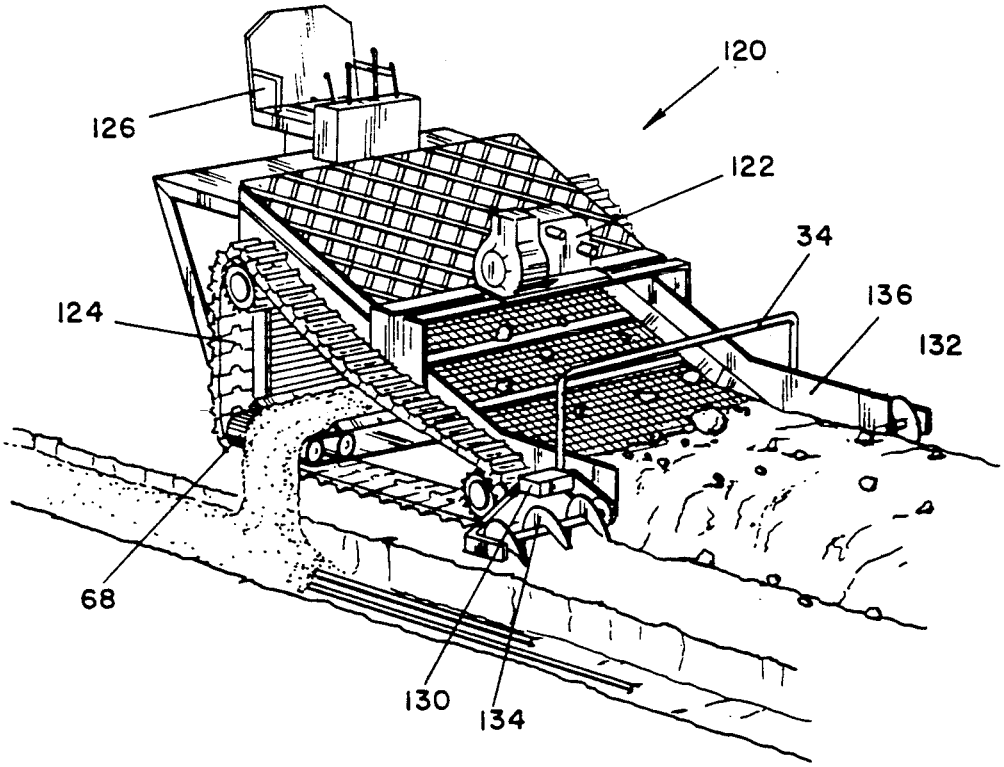
FIG. 12 illustrates another alternative preferred embodiment, in which the front lip of the padding machine is provided with augers for directing soil toward the center of the machine.

FIG. 12 illustrates a padding machine 120 similar to that shown in FIGS. 1 through 6, but provided additionally with augers 132 and 134. The augers 132 and 134 are driven by drive chains 130 and 136 which may be connected to sprockets on the axle of lower roller 46 or driven by dedicated motors (e.g., hydraulic motors) mounted on the padding machine. The augers 130 and 132 operate to collect soil in front of the padding machine 120 and draw it toward the center of the machine, where it is subsequently picked up by the lip 36 and the screening belt 44.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A padding machine comprising:

a frame comprising opposite side members, a front end and a rear end;

a screening conveyor belt disposed between said opposite side members of said frame, said screening conveyor belt comprising openings therein suitable for screening soil to be used as padding material, said screening conveyor belt further comprising an upper run and a lower run;

an imperforate soil receiving conveyor belt disposed between said opposite side members of said frame, said soil receiving conveyor belt being positioned directly beneath said screening conveyor belt, within the path of said screening conveyor belt and between said upper run and said lower run, whereby soil passing through said screening conveyor belt is deposited onto said soil receiving conveyor belt; and a transverse conveyor belt disposed beneath said soil receiving conveyor belt, and means for driving said transverse conveyor belt; and means for driving said screening conveyor belt and said soil receiving conveyor belt such that said screening conveyor belt and said soil receiving conveyor belt both move towards said transverse conveyor belt;

whereby soil carried along said screening conveyor belt is screened by said screening conveyor belt, and whereby soil sufficiently fine grained to pass through said screening conveyor belt passes through said openings therein onto said soil receiving conveyor belt, and whereby the screened soil on said soil receiving conveyor belt is carried towards and discharged onto said transverse conveyor belt, from where it is conveyed transversely and may be discharged alongside said padding machine.

2. The padding machine defined in claim 1 further comprising soil collecting means disposed on said frame.

3. The padding machine defined in claim 2 wherein said soil collecting means comprises a lip disposed on said frame, said lip positioned at ground level.

4. The padding machine defined in claim 1 wherein said screening belt and said soil receiving conveyor belt are inclined upwardly from said front end of said frame to said rear end of said frame.

5. The padding machine defined in claim 4 wherein said transverse conveyor belt is disposed beneath the upper end of said soil receiving conveyor belt.

6. The padding machine defined in claim 4 wherein said screening belt extends in a generally triangular path, with said inclined soil receiving conveyor belt and said transverse conveyor belt both being positioned inside the path of travel of said screening belt.

7. The padding machine defined in claim 1 wherein said screening belt is mounted on a plurality of rollers extending between said opposite side members of said frame.

8. The padding machine defined in claim 1 wherein said soil receiving conveyor belt is mounted on a plurality of rollers extending between said opposite side members of said frame.

9. The padding machine defined in claim 1 further comprising vibrator means coupled to said screening belt, for assisting in breaking up aggregated soil on said screening belt.

10. The padding machine defined in claim 1 wherein said screening belt and said soil receiving conveyor belt travel on a common lower roller, and wherein said means for driving said screening belt and said soil receiving conveyor belt comprises a motor coupled to said screening belt, whereby said screening belt drives said soil receiving conveyor belt.

11. The padding machine defined in claim 10 further including spacer means for separating said screening belt from said soil receiving conveyor belt as said belts emerge from said common lower roller.

12. The padding machine defined in claim 11 wherein said spacer means comprises a plurality of tapered fingers.

13. The padding machine defined in claim 1 wherein said frame comprises attachment means for attaching said padding machine to a conventional vehicle.

14. The padding machine defined in claim 1 wherein said screening belt includes a plurality of transverse cross bars for engaging rocks and soil carried along said screening belt.

15. The padding machine defined in claim 1 wherein said means for driving said screening belt and said soil receiving conveyor belt comprises an engine and associated hydraulic power means.

16. The padding machine defined in claim 1 wherein said transverse conveyor belt travels on rollers journalled to an elongate frame.

17. The padding machine defined in claim 16 wherein said elongate frame rests on support rails, and wherein said elongate frame and said transverse conveyor belt are slidable on said support rail, whereby said transverse conveyor belt may be positioned to extend from either side of said padding machine.

18. The padding machine defined in claim 1 wherein said means for driving said transverse conveyor belt comprises a reversible hydraulic motor mounted within said elongate frame and operable to drive said transverse conveyor belt.

19. The padding machine defined in claim 1 further comprising an auxiliary conveyor belt pivotably attachable to said frame and positioned to receive screened soil discharged from said transverse conveyor belt.

20. The padding machine defined in claim 19 wherein said auxiliary conveyor belt is suspended from pivotable swing arm means, whereby said auxiliary conveyor belt is positionable to discharge screened soil at variable distances from said padding machine.

21. The padding machine defined in claim 1 further comprising an auxiliary attachment attachable to the rear of said frame, said auxiliary attachment including a transverse rock conveyor belt and means for driving said transverse rock conveyor belt, said transverse rock conveyor belt operating to convey rock discharged from said padding machine away from said padding machine or the path of a vehicle to which said padding machine is attached.

22. The padding machine defined in claim 21 wherein said rock conveyor belt of said auxiliary attachment is extendable in either direction from said auxiliary attachment, whereby rocks may be selectively discharged into or away from a trench adjacent said padding machine.

23. The padding machine defined in claim 1 wherein said padding machine is self-propelled.

24. The padding machine defined in claim 23 further comprising a self-contained engine and track means for propelling said padding machine.

25. The padding machine defined in claim 1 further comprising auger means.

26. The padding machine defined in claim 25 wherein said auger means comprises a pair of augers disposed on the front ends of said opposite frame members, said augers being positioned at ground level and being operable to collect soil in front of said padding machine and guide it toward said screening belt.

* * * * *